US008240113B2

(12) United States Patent
Warson et al.

(10) Patent No.: US 8,240,113 B2
(45) Date of Patent: Aug. 14, 2012

(54) WEDGE APPARATUS FOR A STIRRUP TO ALLEVIATE KNEE PAIN IN HORSEBACK RIDERS

(75) Inventors: James Stickney Warson, Durham, NC (US); Jason Asher Bernstein, Alpharetta, GA (US)

(73) Assignee: ThinLine, LLC, Durham, NC (US)

( * ) Notice: Subject to any disclaimer, the term of this patent is extended or adjusted under 35 U.S.C. 154(b) by 184 days.

(21) Appl. No.: 12/817,573

(22) Filed: Jun. 17, 2010

(65) Prior Publication Data

US 2010/0319306 A1 Dec. 23, 2010

Related U.S. Application Data

(60) Provisional application No. 61/187,735, filed on Jun. 17, 2009.

(51) Int. Cl.
*B68B 3/00* (2006.01)

(52) U.S. Cl. ..... 54/47

(58) Field of Classification Search ..... 54/47, 49.5, 54/48; *B68C 03/00*

See application file for complete search history.

(56) References Cited

U.S. PATENT DOCUMENTS

| | | | | |
|---|---|---|---|---|
| 807,793 | A * | 12/1905 | Thompson | 54/47 |
| 1,074,481 | A | 9/1913 | Ward | |
| 4,209,962 | A | 7/1980 | Forest | |
| 4,680,921 | A | 7/1987 | Bezin | |
| D292,628 | S | 11/1987 | Racina | |
| 5,172,538 | A * | 12/1992 | Luger | 54/47 |
| 6,220,004 | B1 * | 4/2001 | Hsi-Chang | 54/48 |
| D458,420 | S | 6/2002 | Abady | |
| 6,925,786 | B2 * | 8/2005 | Sjosward | 54/47 |
| 7,469,523 | B2 * | 12/2008 | Hussey | 54/47 |
| 2005/0039424 | A1 * | 2/2005 | Zucchini | 54/47 |
| 2006/0096256 | A1 * | 5/2006 | Chang | 54/48 |
| 2009/0266039 | A1 | 10/2009 | Gottlieb | |

FOREIGN PATENT DOCUMENTS

WO 0039024 A1 7/2000

* cited by examiner

*Primary Examiner* — Rob Swiatek
*Assistant Examiner* — Thien Thanh Pham
(74) *Attorney, Agent, or Firm* — Jason A. Bernstein; Barnes & Thornburg LLP

(57) ABSTRACT

A wedge apparatus for a stirrup for reducing alleviating pain on a horseback rider's knees and ankles, the stirrup comprising a pair of opposing side bars, a hangar bar portion and a footrest bar, the wedge apparatus comprising (a) a wedge associated with the footrest bar, the wedge having a lateral portion and a medial portion, the lateral portion being thicker than and tapering toward the medial portion; (b) an impact-absorbing material; and, (c) an attachment mechanism for attaching the wedge and the impact-absorbing material to the footrest bar.

4 Claims, 2 Drawing Sheets

WEDGE APPARATUS FOR A STIRRUP TO ALLEVIATE KNEE PAIN IN HORSEBACK RIDERS

CROSS REFERENCE TO RELATED APPLICATION

This application claims benefit of copending U.S. provisional patent application No. 61/187,735, filed Jun. 17, 2009, entitled WEDGED STIRRUP TO ALLEVIATE KNEE PAIN IN HORSEBACK RIDERS, and commonly assigned to the assignee of the present application, the disclosure of which is incorporated by reference in its entirety herein.

FIELD

The present invention relates to equestrian accessories, and, more particularly to a stirrup having a wedge to alleviate knee pain of horseback riders.

BACKGROUND

Horseback riders can experience pain due to stress caused by the impact of the rider's weight on the legs when in stirrups. Current stirrups do not hold the rider's ankle and knee in a neutral position, rather, the stirrup causes improper orientation of the joints. It would be desirable to have a stirrup having a footrest bar which holds the rider's boot in a neutral position, thus alleviating pain.

SUMMARY

Generally described, the present invention provides in a first embodiment a wedge apparatus for a stirrup for reducing stress on a rider's legs, said stirrup comprising a pair of opposing side bars, a hangar bar portion and a footrest bar, the wedge apparatus comprising (a) a wedge associated with said footrest bar, said wedge having a lateral portion and a medial portion, said lateral portion being thicker than and tapering toward said medial portion; (b) an impact-absorbing material; and, (c) an attachment means for attaching said wedge and said impact-absorbing material to said footrest bar. The impact-absorbing material can wrap around the wedge and the footrest bar and be held in place by a fastener, such as laces, bands, ties, or the like.

In alternative embodiment, the wedge comprises a plurality of shims, each shim having a lateral portion and a medial portion, the lateral portion being thicker than and tapering toward the medial portion, the shim traversing at least a portion of the footrest bar. The shims each have a top surface and a bottom surface and include at least one slot on the top surface and at least one tongue extending from the bottom surface which mates with the slot so that the shims can be stacked and maintained in a fixed relationship.

Other features and advantages of the present invention will become apparent upon reading the following detailed description of embodiments of the invention, when taken in conjunction with the appended claims.

BRIEF DESCRIPTION OF THE DRAWINGS

The invention is illustrated in the drawings in which like reference characters designate the same or similar parts throughout the figures of which.

DETAILED DESCRIPTION

Figure 1:
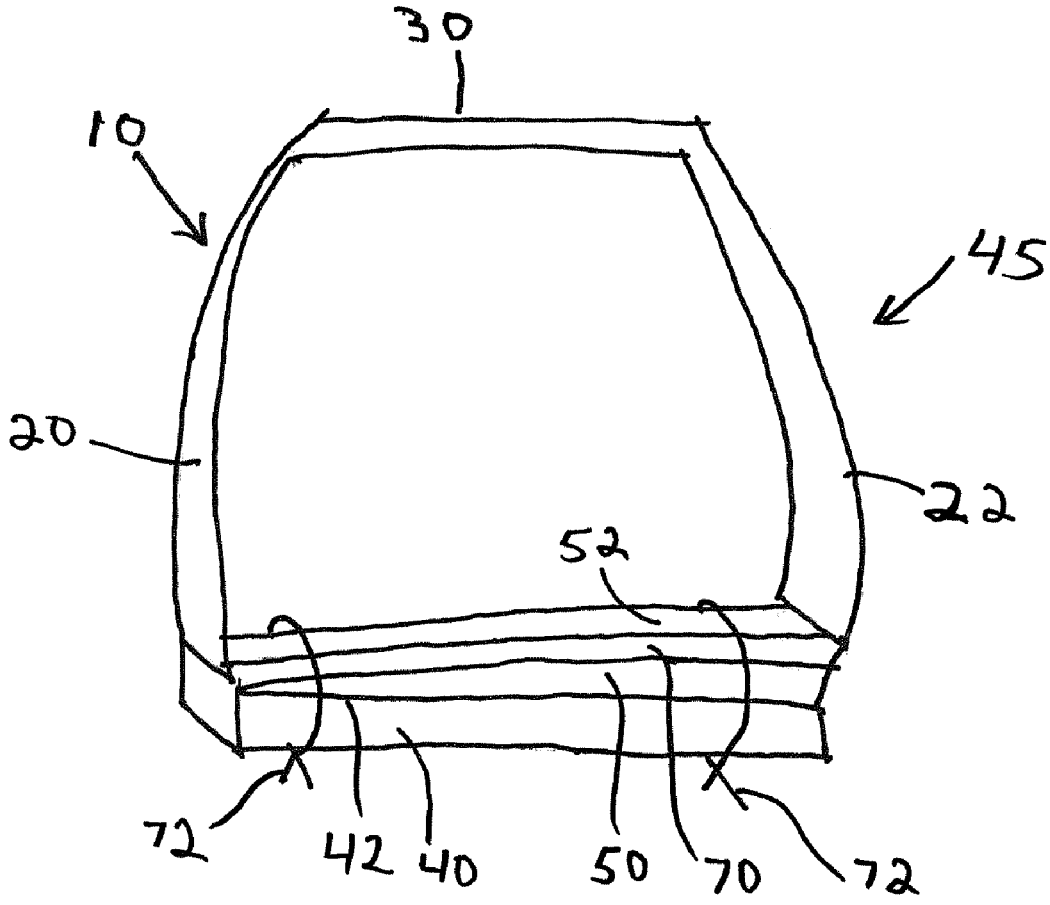
FIG. 1 is a perspective view of one exemplary embodiment of the present invention.

In one exemplary embodiment of the present invention, shown in FIG. 1, a stirrup 10 is comprised of a pair of opposing side bars 20 and 22, referred to as the lateral side bar 20 and the medial side bar 22, the term "medial" referring to the side bar which is nearest to the horse's flank and "lateral" referring to the side bar further away from the horse's flank. The stirrup 10 further comprises a hanger bar 30 and a footrest bar 40. The side bars, footrest bar and hangar bar may be formed of a single piece of material, typically metal or leather (though other materials or combinations of materials are possible), or one or more of the bars may be formed separately. Western stirrups typically have a generally straight horizontal hangar bar to which a length of material (usually leather, and referred to as the "stirrup leathers") can be attached. Eastern stirrups typically have a slightly curved hangar bar and a slot formed therein to which the stirrup leather can be attached.

The footrest bar 40 typically has a generally flat, horizontal top surface 42.

A wedge apparatus 45 includes a wedge 50, which comprises, in one exemplary embodiment, a single piece of material made of any generally durable material, such as, but not limited to, plastic, leather, metal, wood, alloy, composite, foam, cushioned material, mixtures and combinations of the foregoing, and the like. The wedge 50 has a first portion referred to as the lateral portion 52 and a second portion referred to as the medial portion 54. The lateral portion 52 is thicker than and tapers toward the medial portion 54. The wedge 50 may have a smooth top surface or have surface irregularities, ribs, slots, grooves, protrusions, or the like to increase grip.

Figure 2:
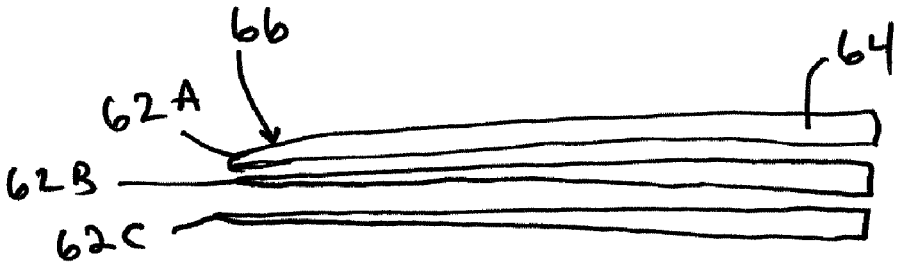
FIG. 2 is a front elevational view of an alternative embodiment of the present invention showing a plurality of wedge shims forming the wedge.
Figure 3:
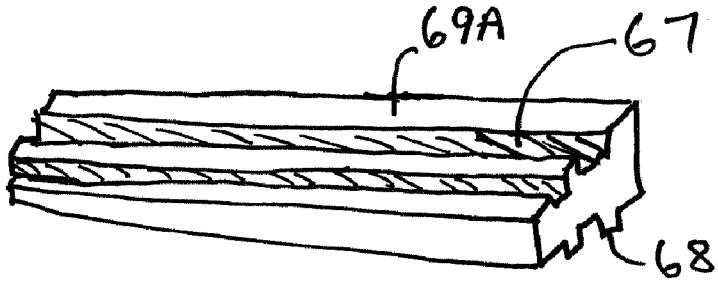
FIG. 3 is a top perspective view of a wedge shim of FIG. 2.
Figure 4:
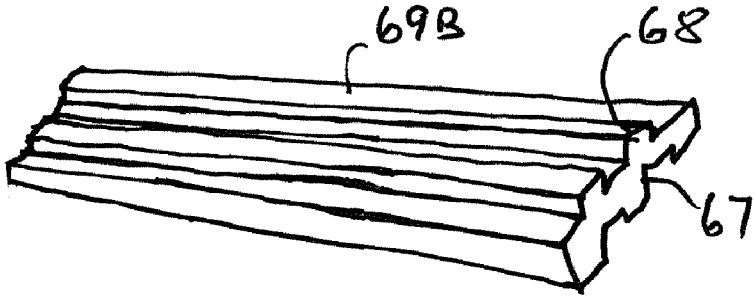
FIG. 4 is a bottom perspective view of a wedge shim of FIG. 2.

In a first alternative embodiment, the wedge 50 may be made of a plurality of wedge shims 62 (see FIG. 2, in which an exemplary embodiment of a wedge 60 is illustrated with three shims 62A, 62B and 62C), each shim 62 having a lateral portion 64 and a medial portion 66. It is to be understood that the number of shims 62 forming the wedge 60 can be selected by the rider. In this alternative embodiment, a set of wedge shims 62 can be included in a product and stacked by the rider to adjust the desired angle. The wedge shims 62 may be made of the same material, or different shims 62A, 62B, etc., can each be made of a distinct material, the stacked combination of shims 62 becoming a set of layers. The shims can be attached to each other using adhesive (such as by a pressure sensitive adhesive applied to the bottom surface of the shim), or by other attachment mechanisms known to those skilled in the art. In one aspect of this embodiment, shown in FIGS. 3 and 4 a series of mating slots or grooves 67 and tabs or tongues 68 in the top surface 69A or bottom surface or 69B of the shims 62. Shims of different materials can be alternated, if desired. The shims 62 can be made with different tapers so that a rider can be provided with a selection of shims 62 to make a desired tapered footrest.

A cushioned pad 70 is attached to, wrapped around, or otherwise associated the wedge 50 (or wedge 60) to absorb impact and to reduce stress on the knee joint and ankle joint. The pad 70 is preferably made of a cushioned or impact-absorbing material, such as, but not limited to, plastic, rubber, gel-filled material, air-filled material, foam, open-cell foam, composite, mesh, tape, leather, Neoprene rubber, cellulose, woven or nonwoven natural or synthetic fabrics, combinations and mixtures of the foregoing, and the like. It is preferable that the pad 70 be made of a material that will be durable when subjected to repeated stress and the exposure to the elements. In one exemplary embodiment, the pad 70 is made of an open-cell foam commercially available as ThinLine™ material, available from ThinLine, LLC (Durham, N.C., www.thinlineglobal.com). It is possible for a wedge apparatus 45 to not include the pad 70 and just include the wedge 50, though the combination of both components improves performance and reduces stress on the rider's leg.

The pad 70 may be made of a nonslip or slip-resistant material or incorporate a nonslip surface or material to reduce the possibility of slippage of the boot sole within the stirrup.

In one exemplary embodiment, the wedge 50 may be constructed to have the lateral portion be approximately ⅛ inch thicker than the medial portion, with the taper being generally straight.

The wedge 50 can be attached to a standard footrest bar 40 by adhesive or may be screwed or bolted into the footrest bar platform using holes in the footrest bar 40 (not shown). In one exemplary embodiment, a first wedge 50 can be screwed into the footrest bar 40 and then a second wedge 50 affixed (such as by an adhesive) to the top surface of the first wedge 50. The pad 70 may be attached to the top surface of the wedge 50 by adhesive, wrapped around the wedge 50, attached by straps, laces, bands, ties, or by other attachment mechanisms and techniques known to those skilled in the art. The wedge 50 may be adapted to snap fit onto the footrest bar 40. In one exemplary embodiment, the wedge 50 is attached to the footrest using a pressure sensitive adhesive (previously coated on the bottom of the wedge 50) and the pad 70, in the form of an elongated wrap of impact-absorbing material, is wrapped around the wedge 50 and the footrest bar 40. The pad 70 is secured to the wedge 50 and footrest bar 40 by a set of laces 72 (shown in FIG. 1) which can be tied on both ends of the wedge apparatus 45, with the knot being on the underside of the footrest bar 40. This arrangement will secure the pad 70 to the wedge 50, yet optionally allow for a slight amount of roll of the pad 70 during use.

The present disclosure also provides a kit comprising at least one, and preferably a plurality of wedges 50 or wedge shims 60 and, optionally, at least one pad 70 for mounting to a conventional stirrup 10. The kit includes an attachment mechanism for attaching the wedge 50 and the pad 70 to the footrest bar 40. The wedge 50 and pad 70 can be made of different sizes to accommodate different width footrest bars 40.

In an alternative embodiment, the stirrup 10 can be molded or otherwise formed with a wedge 50 as an integral part of the footrest bar 40. A kit is provided including a stirrup having a wedge 50 formed therein, an impact-absorbing material, and an attachment mechanism for attaching the impact-absorbing material to the footrest bar 40 and wedge 50. The attachment mechanism may be adhesive, laces, wire, string, bands, or the like.

Alternatively, a customized stirrup 10 can be made having a wedge 50 formed integral with or permanently affixed to the footrest bar 40, and may optionally have a pad 70 affixed to the wedge 50.

In use, the wedge 50 may be attached to the footrest bar 40, and a pad 70 affixed to the wedge 50. Alternatively, the pad 70 can be attached directly to the footrest bar 40 and a wedge 50 attached to the pad 70, sandwiching the pad 70 between the footrest bar 40 and the wedge 50.

The wedge 50 and pad 70 together may form the wedge apparatus 45. The wedge apparatus 45 holds the rider's ankle slightly everted and knee in a neutral position when riding. The minute eversion of the ankle in the stirrup relieves the compression of the medial aspect and the stretching of the lateral aspect of the knee. The wedge apparatus 45 relieves these forces and prevents or reduces functional and later structural genu varum without compromising the lateral joint, thus preventing the likelihood of, or reducing the severity of, knee pain in horseback riders.

While the wedge apparatus 45 of the present disclosure is mainly adapted for use with a horseback rider who places appreciable stress on the knee when riding based on the curvature of the horse's body around which the leg is partially wrapped, the present invention can be adapted for use in other structures in which a user places force on a generally horizontal bar or surface and exerts force thereon using, to at least some degree, and thus potentially stressing to some degree, the knee structure. Accordingly, the wedge system 80 of the present disclosure can be adapted for use in motorcycle footrest bars, bicycle or tricycle pedals, fitness machine foot pedals (such as, but not limited to, stationary bicycles, recumbent bicycles, stair-climbing apparatus), jet skis, ski bindings, water ski bindings, and the like.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. It should further be noted that any patents, applications and publications referred to herein are incorporated by reference in their entirety.

What is claimed is:

1. A wedge apparatus for a stirrup for reducing stress on a rider's legs, said stirrup comprising a pair of opposing side bars, a hangar bar portion and a footrest bar, the wedge apparatus comprising:

a) a wedge associated with said footrest bar, said wedge having a lateral portion and a medial portion, said lateral portion being thicker than and tapering toward said medial portion;

b) an impact-absorbing material; and, c) attachment means for attaching said wedge and said impact-absorbing material to said footrest bar, wherein said wedge comprises a plurality of shims, each shim having a lateral portion and a medial portion, said lateral portion being thicker than and tapering toward said medial portion, said shim traversing at least a portion of said footrest bar.

2. The wedge apparatus of claim 1, wherein each of said shims has a top surface and a bottom surface and includes at least one slot on said top surface and at least one tongue extending from said bottom surface which mates with said at least one slot so that said shims can be stacked and maintained in a fixed relationship.

3. The stirrup of claim 2, wherein each of said shims can be fixedly or removably attached to each other.

4. The stirrup of claim 2, wherein each of said shims has a top surface and a bottom surface and includes at least one slot on said top surface and at least one tongue which mates with said at least one slot so that said shims can be stacked.

* * * * *